US006919671B2

(12) United States Patent
Bachetzky et al.

(10) Patent No.: US 6,919,671 B2
(45) Date of Patent: Jul. 19, 2005

(54) COMPACT LOW-PRESSURE DISCHARGE LAMP

(75) Inventors: Bruno Bachetzky, Augsburg (DE); Andreas Jakob, Langerringen (DE); Thomas Noll, Kipfenberg (DE)

(73) Assignee: Patent-Treuhand-Gesellschaft fur Elektrisch Gluhlampen mbH, Munich (DE)

( * ) Notice: Subject to any disclaimer, the term of this patent is extended or adjusted under 35 U.S.C. 154(b) by 0 days.

(21) Appl. No.: 10/319,483

(22) Filed: Dec. 16, 2002

(65) Prior Publication Data

US 2003/0117062 A1 Jun. 26, 2003

(30) Foreign Application Priority Data

Dec. 20, 2001 (DE) ..... 101 63 096

(51) Int. Cl.[7] ..... H01J 61/56; H01J 9/34

(52) U.S. Cl. ..... 313/318.01; 313/318.11; 313/318.12; 313/318.1; 439/226

(58) Field of Search ..... 313/318.01, 318.03, 313/318.04, 318.09, 318.1, 318.11, 318.12, 493, 634; 439/226, 619

(56) References Cited

U.S. PATENT DOCUMENTS 3,906,275 A * 9/1975 Spiessens et al. ..... 313/318.07
6,008,570 A 12/1999 Helbig et al.
6,144,146 A * 11/2000 Cserteg et al. ..... 313/318.01
6,445,131 B1 * 9/2002 Wursching et al. .... 313/318.01

FOREIGN PATENT DOCUMENTS

| | | |
|---|---|---|
| EP | 0 044 196 | 1/1982 |
| WO | 01/01437 | 1/2001 |

* cited by examiner

*Primary Examiner*—Joseph Williams
*Assistant Examiner*—Sharlene Leurig
(74) *Attorney, Agent, or Firm*—Carlo S. Bessone

(57) ABSTRACT

The invention relates to a compact low-pressure discharge lamp (1) comprising a discharge vessel (3) with electrodes and power supply leads (7), a discharge vessel mount on which the discharge vessel is mounted, and a cap (10), which comprises a housing (11), connecting contacts (12) and a mounting plate (13) with a ballast apparatus (15), with the mounting plate being fitted with the ballast arrangement in the interior of the cap housing, and having connections for electrical connection of the mounting plate to the power supply leads and to the connecting contacts. The discharge vessel mount in this case comprises a plate (5) which is mounted in a further mount, with the further mount in turn being mounted on the housing of the cap. The further mount may be in the form of an enveloping bulb (2) or a reflector for the discharge vessel, or in the form of a closure cap (20) for the cap housing.

16 Claims, 3 Drawing Sheets

COMPACT LOW-PRESSURE DISCHARGE LAMP

TECHNICAL FIELD

The invention relates to a compact low-pressure discharge lamp comprising a discharge vessel with electrodes and power supply leads, a discharge vessel mount on which the discharge vessel is mounted and a cap, which comprises a housing, connecting contacts and a mounting plate with a ballast arrangement, with the mounting plate being fitted with the ballast arrangement in the interior of the cap housing, and having connections for electrical connection of the mounting plate to the power supply leads and to the connecting contacts.

BACKGROUND ART

Low-pressure discharge lamps such as these may also be provided with a reflector or an enveloping bulb. For relatively high wattages, the discharge vessel in this case comprises a tube which is composed of one or more pieces and is bent a number of times, and which is held in the housing with the aid of a mount part, whose shape is complex and which is composed of plastic or metal. One example of this is described in U.S. Pat. No. 4,456,854.

The mount part, whose shape is complex, for the discharge vessel leads firstly to correspondingly large dimensions for the low-pressure discharge lamp and secondarily necessitates manual assembly of the lamp. The production costs for such compact low-pressure discharge lamps are thus relatively high.

DISCLOSURE OF THE INVENTION

The object of the invention is therefore to provide a compact low-pressure discharge lamp comprising a discharge vessel with electrodes and power supply leads, a discharge vessel mount on which the discharge vessel is mounted and a cap, which comprises a housing, connecting contacts and a mounting plate with a ballast arrangement, with the mounting plate being fitted with the ballast arrangement in the interior of the cap housing, and having connections for electrical connection of the mounting plate to the power supply leads and to the connecting contacts, whereby the compact low-pressure discharge lamp has a compact structure and can be produced easily, and hence cost-effectively.

The object is achieved by a discharge vessel mount that comprises a plate, the discharge vessel mount, which is in the form of a plate, is mounted in a further mount, and the further mount is mounted on the housing of the cap.

Advantageous refinements are described in the dependant claims.

The further mount may be in the form of an enveloping bulb or a reflector for the discharge vessel. This further mount may also be in the form of a closure cap for the cap housing when the compact discharge lamp configuration has no enveloping bulb or reflector.

In the case of a circular cylindrical cap housing, the plate is advantageously circular.

The mounting of the discharge vessel is very simple if the plate has two apertures for holding the ends of the discharge vessel. The ends can then either be mounted on the plate by means of a hot fusion method, as stated in WO 0,101,437, or in a conventional manner by means of cap cement. In the second case, the plate advantageously has a holding edge, for holding the cap cement, around the apertures.

On the side facing the cap, the plate advantageously has holders for contacts for electrical connection of the power supply leads to the electrical connections of the ballast arrangement on the mounting plate. One example of appropriate contact-making can be found in U.S. Pat. No. 6,008,570, where a simple electrical connection is produced between the power supply leads of the discharge vessel and the connections of the ballast arrangement on the mounting plate by means of spring elements which are held in holders on the closure cap.

In order to hold the plate in a simple manner in the further mount, the further mount has an at least partially circumferential groove on the inner face of its casing surface, in which groove at least parts of the edge of the plate engage when the plate is being mounted in the further mount.

In addition, the further mount may have a partially circumferential bead at right angles to its axis of symmetry on the inner face of the casing surface, as a stop for the plate, and the plate may have apertures for holding tools to engage in. This makes it considerably easier to install the mounting plate with the discharge vessel in the further mount, which is in the form of an enveloping bulb, reflector or closure cap.

For assembly of the further mount and cap, the further mount has an at least partially circumferential bead, at right angles to its axis of symmetry, on the outer face of its casing surface close to the end facing the cap, which bead engages in a correspondingly shaped groove on the inner face of the cap housing.

The cap housing also has an at least partially circumferential stop at right angles to its axis of symmetry on the inner face of its casing surface, on which stop the edge of the mounting plate rests in the direction of the connecting contacts. Furthermore, the further mount is designed such that, when the low-pressure discharge lamp is in the assembled state, the edge of its end facing the cap presses the mounting plate against this partially circumferential stop on the inner face of its casing surface. In consequence, once the lamp comprising the further mount and cap has been assembled, this ensures that the mounting plate is seated firmly together with the ballast arrangement in the lamp.

In order to prevent damage to the parts during assembly, the further mount has a number of short slots, distributed over the circumference, parallel to its axis of symmetry at its end facing the cap. This allows appropriate size compensation if the shapes do not match exactly.

The mount is advantageously composed of plastic, in the same way as the further mount, which is in the form of a reflector, enveloping bulb or closure cap.

The optional configuration of the further mount as an enveloping bulb, reflector or closure cap makes it simple during production to change from compact low-pressure discharge lamps without enveloping bulbs to the same lamp type with an enveloping bulb or reflector. The pure plug-in and catching connections allow the lamp to be assembled very much more simply and fully automatically.

BRIEF DESCRIPTION OF THE DRAWINGS

Further details, features, refinements and advantages can be found in the following description of a number of exemplary embodiments, which are illustrated in drawings, of the subject matter of the invention, in which.

BEST MODE FOR CARRYING OUT THE INVENTION

Figure 1:
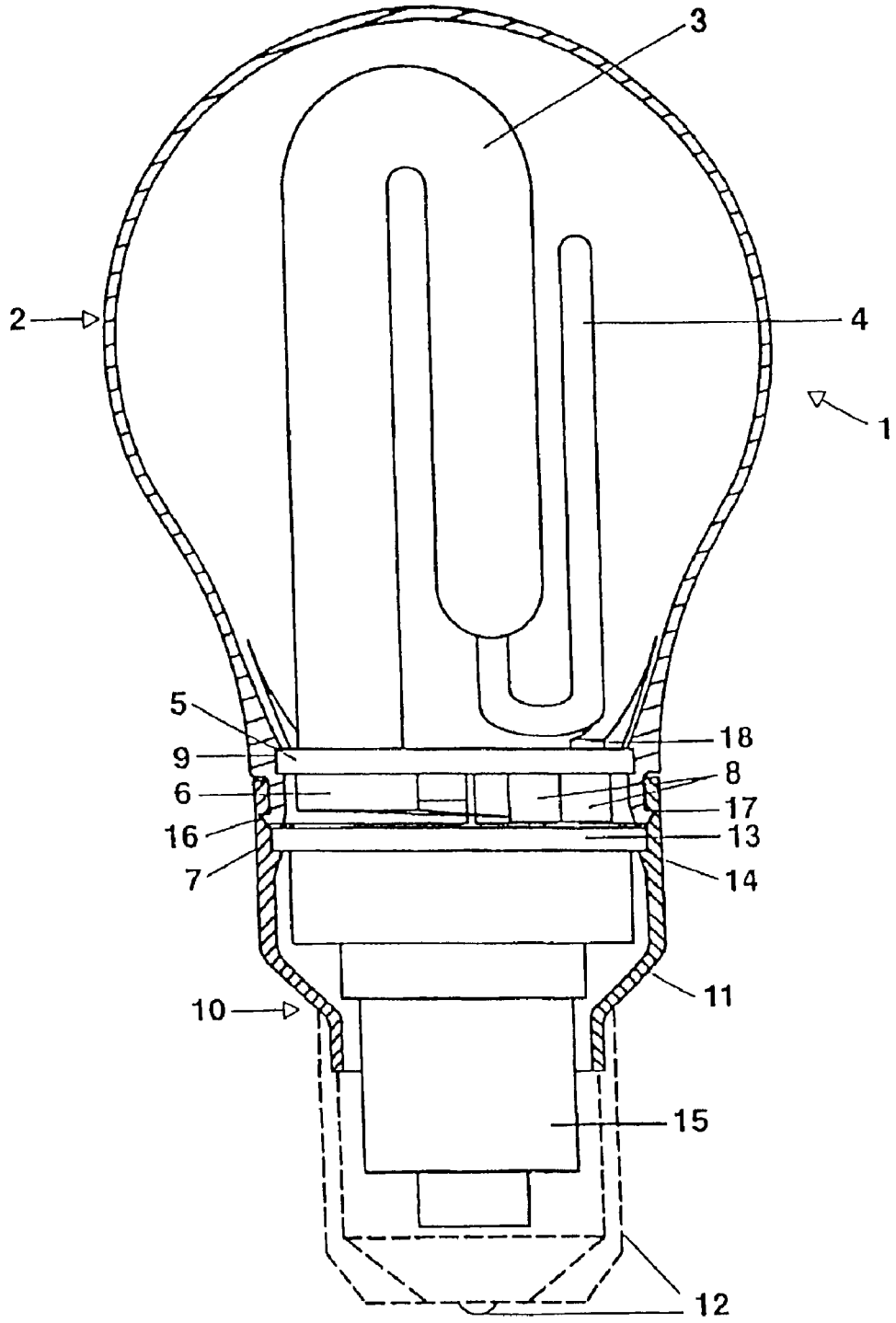
FIG. 1 shows a sectioned side view, illustrated partially schematically, of the low-pressure discharge lamp according to the invention with an enveloping bulb.

FIG. 1 shows a sectioned side view of a compact low-pressure discharge lamp 1 according to the invention having an enveloping bulb 2. The lamp has a discharge vessel 3 which is wound a number of times and has an amalgam filling, with which the pump tube 4 is filled. The ends of the discharge vessel are pushed into apertures in a mounting plate 5 composed of plastic, and are mounted by means of cap cement (which cannot be seen here) in the surrounding edge 6, which is in the form of a bead, of the apertures. The electrodes, which are fused into the ends of the discharge vessel 3, are connected via power supply leads 7 to contacts, which are mounted by means of holders 8 on the mounting plate 5.

The edge of the mounting plate 5 is snapped into a circumferential groove 9 on the inner wall of the enveloping bulb 2.

The low-pressure discharge lamp 1 also has an essentially cylindrical cap 10 with a housing 11 and schematically illustrated connecting contacts 12. A mounting plate 13 rests on a circumferential stop 14, at right angles to the longitudinal axis, in the interior of the housing 11. The mounting plate 13 is in the form of a circuit board, with conductor tracks that are fitted with SMD components being formed on the side facing the discharge vessel 3, and circuit elements of a ballast arrangement 15 being mounted on the side facing away from the discharge vessel 3.

The enveloping bulb 2 with the discharge vessel mount 5 is connected in a manner which cannot be detached by those not skilled in the art to the housing 11 of the cap 10 via an annular bead 16 on the outer casing surface of the enveloping bulb close to the free opening, and engages in a corresponding annular groove 17 in the inner circumference of the housing 11. When the enveloping bulb 2 is being mounted on the housing 11 of the cap 10, the mounting plate 13 is also pressed against the circumferential stop 14, and the mount 5, which is in the form of a plate, for the discharge vessel 3 is pressed against corresponding webs 18 on the inner wall of the enveloping bulb 2. In the process, spring lugs, which are not illustrated here, on the contacts are pressed against corresponding conductor track connections, thus producing an electrical connection between the ballast arrangement and the electrodes.

Figure 2:
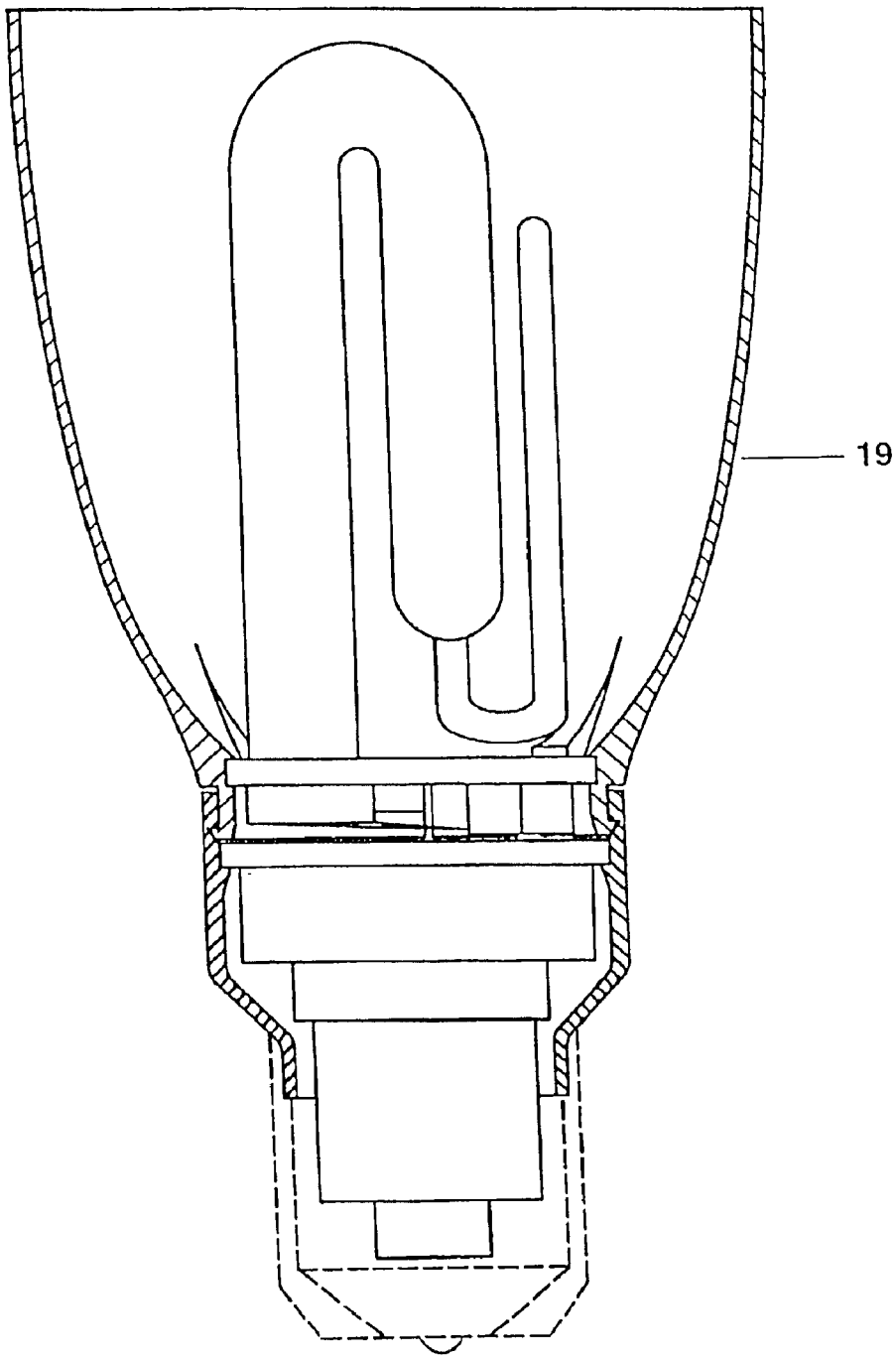
FIG. 2 shows a sectioned side view, illustrated partially schematically, of the low-pressure discharge lamp according to the invention with a reflector.

FIG. 2 shows a low-pressure discharge lamp according to the invention having a reflector 19. In this case, the further mounting plate, together with the first mounting plate which supports the discharge vessel, is not in the form of an enveloping bulb, but is in the form of a reflector 19. The other components and the nature of the connection of these parts correspond to those of the low-pressure discharge lamp with an enveloping bulb as illustrated in FIG. 1.

Figure 3:
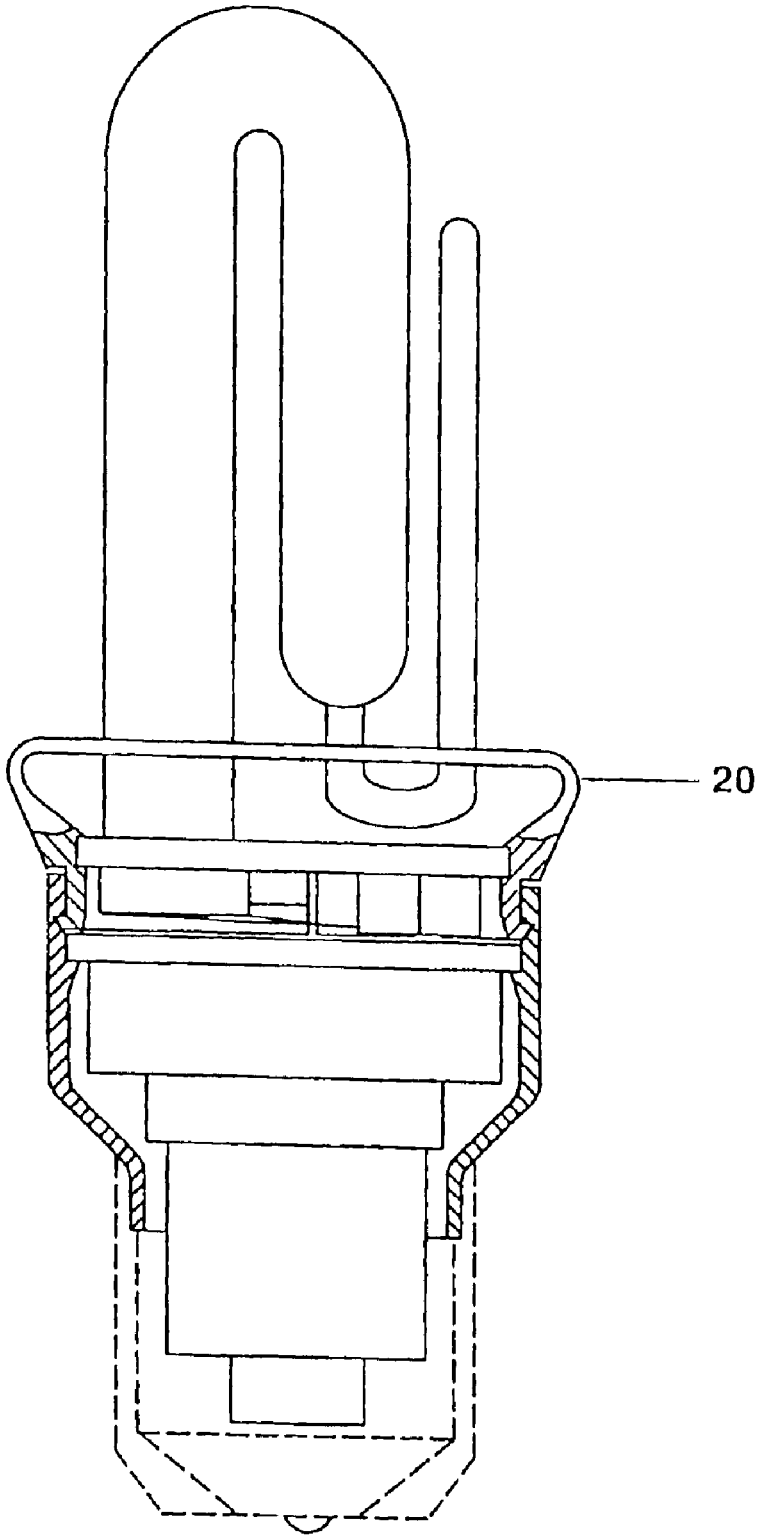
FIG. 3 shows a sectioned side view, illustrated partially schematically, of the low-pressure discharge lamp according to the invention with a closure cap.

FIG. 3 shows a low-pressure discharge lamp according to the invention having only a closure cap 20. The mounting plate with the discharge vessel is in this case mounted, as in the preceding figures, in the further mounting plate, with this further mounting plate in this case being in the form of a closure cap 20. All the other parts and connections are the same.

What is claimed is:

1. A compact low-pressure discharge lamp comprising:

a discharge vessel with electrodes and power supply leads;

a cap, which comprises a housing, connecting contacts and a mounting plate with a ballast arrangement, with the mounting plate being fitted with the ballast arrangement in the interior of the cap housing, and having connections for electrical connection of the mounting plate to the power supply leads and to the connecting contacts; and a discharge vessel mount on which the discharge vessel is mounted which comprises a circular plate which is mounted in a further mount, the further mount in turn being mounted on the housing of the cap, the further mount is shaped such that, when the low-pressure discharge lamp is in the assembled state, the edge of its end facing the cap presses the mounting plate against a partially circumferential stop on the inner face of the cap housing so as to prevent detachment of the further mount from the housing of the cap.

2. The low-pressure discharge lamp as claimed in claim 1, in that the further mount is in the form of an enveloping bulb for the discharge vessel.

3. The low-pressure discharge lamp as claimed in claim 1, in that the further mount is in the form of a reflector for the discharge vessel.

4. The low-pressure discharge lamp as claimed in claim 1, in that the further mount is in the form of a closure cap for the cap housing.

5. The low-pressure discharge lamp as claimed in claim 1, in that the plate is composed of plastic.

6. The low-pressure discharge lamp as claimed in claim 1, in that the plate has at least two apertures for holding the two ends of the discharge vessel.

7. The low-pressure discharge lamp as claimed in claim 1, in that, on the side facing the cap, the plate has holders for contacts for electrical connection of the power supply leads to the electrical connections of the ballast arrangement on the mounting plate.

8. The low-pressure discharge lamp as claimed in claim 1, in that the plate has apertures for holding tools to engage in.

9. The low-pressure discharge lamp as claimed in claim 1, in that the plate has a holding edge around the apertures for holding the ends of the discharge vessel, on the side of the plate facing the cap.

10. The low-pressure discharge lamp as claimed in claim 1, in that the further mount has an at least partially circumferential groove on the inner face of its casing surface, into which groove at least parts of the edge of the plate engage in order to mount the plate in the further mount.

11. The low-pressure discharge lamp as claimed in claim 1, in that the further mount has webs as a stop for the plate on the inner face of the further mount.

12. The low-pressure discharge lamp as claimed in claim 1, in that the further mount is composed of plastic.

13. The low-pressure discharge lamp as claimed in claim 1, in that the further mount is composed of glass.

14. The low-pressure discharge lamp as claimed in claim 1, in that the further mount has an at least partially circumferential bead, at right angles to its axis of symmetry, on the outer casing surface close to the end facing the cap, which bead engages in correspondingly shaped grooves on the inner face of the cap housing, for mounting of the further mount.

15. The low-pressure discharge lamp as claimed in claim 1, in that the cap housing has an at least partially circumferential stop, at right angles to its axis of symmetry, on the inner face of its casing surface, on which stop the edge of the mounting plate rests.

16. The low-pressure discharge lamp as claimed in claim 1, in that the further mount has a number of short slots, distributed over the circumference, parallel to its axis of symmetry at its end facing the cap.

* * * * *